US010271608B2

(12) United States Patent
Madden

(10) Patent No.: US 10,271,608 B2
(45) Date of Patent: Apr. 30, 2019

(54) OPEN FOOTWEAR WITH RIGID, POROUS SURFACE

(71) Applicant: Thomas Harry Madden, Glastonbury, CT (US)

(72) Inventor: Thomas Harry Madden, Glastonbury, CT (US)

(73) Assignee: Thomas H. Madden, Glastonbury, CT (US)

( * ) Notice: Subject to any disclaimer, the term of this patent is extended or adjusted under 35 U.S.C. 154(b) by 12 days.

(21) Appl. No.: 15/656,556

(22) Filed: Jul. 21, 2017

(65) Prior Publication Data

US 2019/0021436 A1 Jan. 24, 2019

(51) Int. Cl.

| | |
|---|---|
| ***A43B 13/04*** | (2006.01) |
| ***A43B 3/12*** | (2006.01) |
| ***A43B 13/14*** | (2006.01) |
| ***A43B 13/02*** | (2006.01) |

(52) U.S. Cl.

CPC ..... *A43B 3/128* (2013.01); *A43B 13/026* (2013.01); *A43B 13/04* (2013.01); *A43B 13/141* (2013.01)

(58) Field of Classification Search

None

See application file for complete search history.

(56) References Cited

U.S. PATENT DOCUMENTS

| | | | | |
|---|---|---|---|---|
| 2,143,897 | A * | 1/1939 | Oriola | C08K 3/013 523/150 |
| 2,976,624 | A * | 3/1961 | Rollman | A43B 13/12 36/14 |
| 4,914,837 | A | 4/1990 | Rieffel | |
| 5,753,357 | A * | 5/1998 | Filipitsch | A43B 1/0045 36/43 |
| 7,866,062 | B2 * | 1/2011 | Yang | A43B 3/108 36/100 |
| 2004/0194342 | A1 * | 10/2004 | Steinberg | A43B 3/108 36/11.5 |
| 2014/0137441 | A1 * | 5/2014 | Gudgel | A43B 23/24 36/136 |

FOREIGN PATENT DOCUMENTS

| | | | | |
|---|---|---|---|---|
| CN | 2704355 B1 | | 3/2004 | |
| CN | 2018468897 U | * | 1/2011 | A43B 13/14 |
| CN | 201846897 A1 | | 6/2011 | |
| CN | 102366183 A | * | 3/2012 | A43B 13/04 |
| CN | 102366183 A1 | | 3/2012 | |
| GB | 433452 A | * | 8/1935 | C08G 65/4006 |

OTHER PUBLICATIONS

Quantitative Porosity Studies of Archaeological Ceramics by Petreographic Image Analysis, Reedy et al., Mater.Res.Soc. Symp. Proc. vol. 1656, 2014 (Year: 2014).*

* cited by examiner

*Primary Examiner* — Peter A Salamon

(57) ABSTRACT

It is desired to teach an open footwear article where the upper surface contacting the foot is partially combined with, or wholly comprised of, a substantially rigid material that has some degree of open porosity. The purpose of said rigid, porous material serves to immediately absorb perspiration and/or water from the feet. Subsequent drying of the porous, rigid material occurs when the sandal is not in use as water/perspiration are evaporated from within the pores. The porous, rigid material also effects a massaging action while walking. It is the intent of this invention to capture a preferred combination of these two embodiments.

16 Claims, 3 Drawing Sheets

OPEN FOOTWEAR WITH RIGID, POROUS SURFACE

BACKGROUND OF THE INVENTION

Many examples of sandals can be purchased widely at major suppliers and outlets. In addition to standard foam rubber sandals that appear to be most common, there are other specialty sandals that serve various niche markets. Massage sandals feature raised embossments on the insole that attempt to simulate a massaging action while walking. Birkenstock sandals have specially textured surfaces made of cork or rubber that gradually mold to the shape of the user's foot after extended walking.

Sandals, or forms of open footwear, are typically worn either in casual/informal situations, and/or ones that involve some degree of water exposure to the foot. It is common that cost-effective, water-resistant materials are used partially/wholly in the sandal construction, such as ethyl-vinyl acetate (EVA), polyurethane (PU), poly-ethylene (PE), poly-vinyl chloride (PVC), thermo-plastic rubbers (TPR) or pure rubber, as well as combinations of these polymers. In no instance is the combination of a rigid, porous material, effecting both a drying and massaging function, and a non-rigid material that comprise the remainder of the open footwear, taught.

There exists some related prior art along these lines:

EP0685257B1 (priority date May 26, 1995) describes shoe insoles that include a moisture absorbent material, and more particularly to a shoe insole of the type comprising at least two interconnected layers of material, of which at least one layer is moisture permeable and one layer defines at least one space filled with the moisture absorbent material. WO95/33555 (priority date May 26, 1995), and related cases, describe moisture absorbent material comprising a porous matrix of adsorbent material, with the pores containing a crystalline deliquescent compound. WO97145206 (priority date May 30, 1996), and related cases, describe an open cell polyurethane, non-swelling foam impregnated or coated into a non-woven fabric, comprising super absorbent ingredient particles. The disclosed material is a super absorbent, fluid locking, moldable footwear product that takes body fluids away from the surface, and gels or locks the fluids in place even while under pressure. The material is breathable and releases fluids through evaporation. US20080120869 (priority date Nov. 26, 2006) describes a footwear cover that has an inner-surface comprised of a water absorbent material. The moisture absorbent material is generally comprised of desiccating salt and/or metal oxide powders. References therein describe the general incorporation of porous, granular material into the matrix of the insole. EP2095733A1 (priority date Jul. 6, 2007) describes an absorbent insole which has the dual function of being absorbent and transpire-able while simultaneously providing a shock absorbent function. The resulting insole is realized in multiple, continuous layers (up to 5 discrete layers) the first layer being water repellant and subsequent layers being water absorbent by being comprised of hydrophilic, micro-porous materials. The main intention is to direct moisture from the foot continuously downward to the base layer, where it is presumably stored for re-evaporation when the footwear is not in use. EP2167725B1 (priority date Jul. 17, 2007) describes having a liquid-repelling and vapor permeable polymeric coating, obtained by a plasma treatment process, provided over the entire item of footwear and combined with a liquid-absorbing foot supporting foot-bed. U.S. Pat. No. 7,055,265 (priority date Aug. 29, 2002) describes a sandal system that has inter-changeable insoles that may be tailored to specific activities and exhibit different properties. U.S. Pat. No. 7,866,062 (priority date Oct. 13, 2004) describes a sandal wherein an insert-able body, amenable to absorbing impact, is designed to insert into a cavity in the main body of the sandal, U.S. Pat. No. 8,151,487 (priority date Jun. 2, 2005) describes a liner for footwear that is designed to absorb and dissipate moisture, comprising a moisture absorbing material with certain frictional characteristics that extends beyond the foot, and an adhesive layer designed to adhere the assembly to the footwear. None of the previous art describes a sandal that is partially or wholly comprised of a rigid porous material, such as sandstone. It is the focus of this application to describe a sandal whose contact surface with the foot is preferentially comprised partially or wholly of a rigid, porous material.

SUMMARY OF THE INVENTION

This application is in the field of open footwear, particularly sandals. It is desired to teach a sandal where the upper surface contacting the foot is partially combined with, or wholly comprised of, a substantially rigid material that has some degree of open porosity. The purpose of said rigid, porous material serves to immediately absorb perspiration and/or water from the feet. Subsequent drying of the porous, rigid material occurs when the sandal is not in use as water/perspiration are evaporated from within the pores. The porous, rigid material also effects a massaging action while walking. It is the intent of this invention to capture a preferred combination of these two embodiments.

It is expected that this subject invention will find especially favorable utility in gymnasium applications, where the sandal is worn to/from showering. As opposed to waterproof polymers that do not absorb water, the subject invention actively moves water away from the foot, thereby reducing the chances for fungus to grow that can result in athlete's foot.

DETAILED DESCRIPTION OF THE INVENTION

A description of preferred embodiments will be given in detail with reference to the attached drawings.

Figure 1:
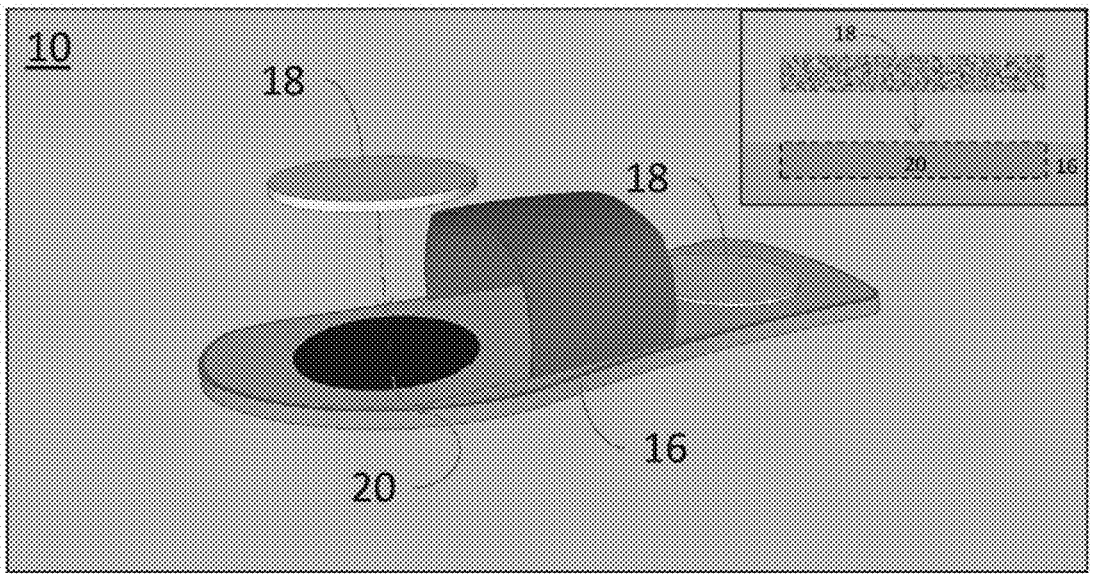
FIG. 1 is a depiction of a sandal surface that is being partially modified with a thin, cylindrical, rigid, porous material component.

In FIG. 1, a common sandal 16 composed of a flexible, water resistant polymer is shown with a cavity 20 that is designed to receive a thin, cylindrical body comprised of a rigid, porous material 18. The inset in FIG. 1 illustrates that the cavity 20 that accepts the rigid, porous material only partially penetrates the thickness of the sandal sole 16. This rigid, porous material is not meant to be removable; rather, it is illustrated as a means to fabricate the completed assembly 12 in FIG. 2.

Figure 2:
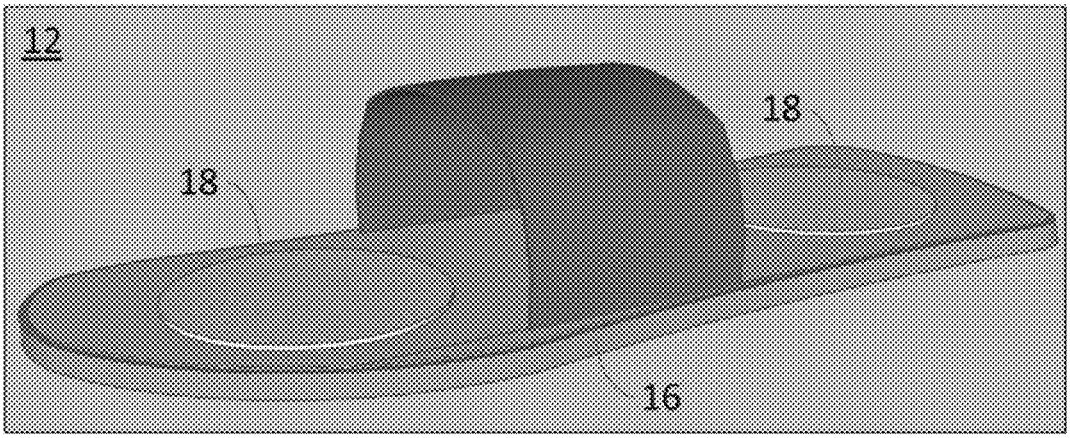
FIG. 2 is a depiction of the fully modified sandal in its usable state.

FIG. 2 depicts a fully-assembled preferred embodiment of the subject invention. In this embodiment, the rigid, porous material 18 is cylindrical, and of such a thickness so as to protrude slightly from the main polymer surface of the sandal. Under typical loads from the weight of the wearer, the rigid, porous material should compress to roughly flush with the surface. In this embodiment, the surface is preferably only partially modified with the rigid, porous material, preferably further in areas of contact of the foot, such as the ball and heel areas.

Figure 3:
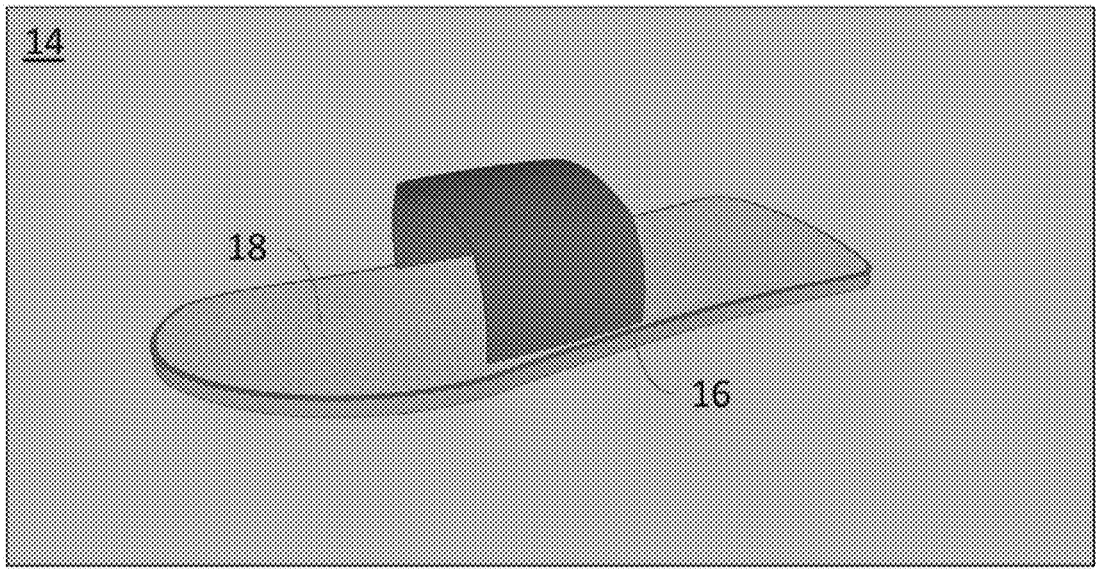
FIG. 3 is another depiction, wherein the entire surface is comprised of a rigid, porous material.

FIG. 3 depicts a further embodiment, wherein the entire surface of the sandal is comprised of a rigid, porous material 18. Preferably, the rigid, porous material does not comprise the entire body of the sandal. Therefore, the base of the sandal 16 is still comprised of a type of polymer as articulated earlier.

A preferred embodiment can be taught in the form that the rigid, porous material 18 is comprised partially, substantially, or wholly of sandstone. In this context, sandstone can refer to the broad class of quartz and feldspar combinations that are found in typical sandstones used in commodity applications. When the sandal surface material is comprised partially or wholly of sandstone, an optimum combination of water removal and massaging activity for the bottom of the feet can occur. A particularly advantageous combination involves configuring the subject invention using existing commodity components. Such components include deploying sandstone coasters as the rigid, porous material with a sandal modified to accept them.

The degree of porosity of the rigid, porous material may vary, but is preferably in the 1 to 40% range, further preferably in the 1 to 20% range, and even further preferably in the 1 to 10% range. Adequate porosity for the removal of liquids should be facilitated without compromising the structural integrity of the rigid, porous material under typical loads. Also, the degree of rigidity of the rigid, porous material can be defined using the "modulus-of-rigidity" quantity. Preferable materials will have a modulus-of-rigidity in the range of 0.1 to 25 GPa, further preferably in the range 0.1 to 10 GPa, and even further preferably in the range 0.1 to 5 GPa.

The ideal composition of the sandal body 16 in the preferred embodiment is a flexible polymer, such as such as ethyl-vinyl acetate (EVA), polyurethane (PU), poly-ethylene (PE), poly-vinyl chloride (PVC), thermo-plastic rubbers (TPR) or pure rubber, as well as combinations of these polymers, which are typically employed in waterproof sandals. These combinations may further exist in an open or closed-pore structure. Because such polymers are, to a degree, flexible, they will be compressed under the load of the rigid, porous material. When properly designed, loading weight of the wearer will be partially transmitted through the rigid, porous material to the underlying polymer layer and result in compression. In this way, the rigid, porous material will transmit load to the underlying polymer which will reduce the tendency for the rigid, porous material to fracture under repeated load/unload cycles. Again, under such compression, the cavity 20 is designed such that, under typical compressions, the top surface of the rigid, porous material is not compressed into the sandal body 16 any further than approximately flush with the surface.

While the present invention has been described with reference to the preferred, illustrative embodiments, it is not to be restricted by these but only by the appended claims. It is to be appreciated that those skilled in the art can change or modify the embodiments without departing from the scope and spirit of the present invention.

What is claimed is:

1. An open footwear article whose contact surface with the foot is partially comprised of sandstone and a non-rigid portion of the footwear article wherein the non-rigid portion of the footwear article comprises ethyl-vinyl acetate (EVA), polyurethane (PU), poly-ethylene (PE), poly-vinyl chloride (PVC), thermos-plastic rubber (TPR) or pure rubber as well as combinations of these polymers.

2. The article of claim 1, wherein the sandstone has a degree of porosity of 1-40%.

3. The article of claim 2, wherein the sandstone has a degree of porosity of 1-20%.

4. The article of claim 3, wherein the sandstone has a degree of porosity of 1-10%.

5. The article of claim 2, wherein the sandstone has a modulus-of-rigidity of 0.1-25 GPa.

6. The article of claim 5, wherein the sandstone has a modulus-of-rigidity of 0.1-10 GPa.

7. The article of claim 6, wherein the sandstone has a modulus-of-rigidity of 0.1-5 GPa.

8. The article of claim 1, wherein the sandstone material deployed is also produced for another application.

9. An open footwear article whose contact surface with the foot is wholly comprised of sandstone and a non-rigid portion of the footwear article wherein the non-rigid portion of the footwear article comprises ethyl-vinyl acetate (EVA), polyurethane (PU), poly-ethylene (PE), poly-vinyl chloride (PVC), thermos-plastic rubber (TPR) or pure rubber as well as combinations of these polymers.

10. The article of claim 9, wherein the sandstone has a degree of porosity of 0.1-40%.

11. The article of claim 10, wherein the sandstone has a degree of porosity of 0.1-20%.

12. The article of claim 11, wherein the sandstone has a degree of porosity of 0.1-10%.

13. The article of claim 10, wherein the sandstone has a modulus-of-rigidity of 0.1-25 GPa.

14. The article of claim 13, wherein the sandstone has a modulus-of-rigidity of 0.1-10 GPa.

15. The article of claim 14, wherein the sandstone has a modulus-of-rigidity of 0.1-5 GPa.

16. The article of claim 8, where the other application is a coaster.

* * * * *